US005932313A

United States Patent [19]

Barton

[11] Patent Number: 5,932,313

[45] **Date of Patent: *Aug. 3, 1999**

[54] RUBBER-BASED PAPER FEED ROLLERS

[75] Inventor: William H. Barton, Nicholasville, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,831

[22] Filed: Apr. 17, 1997

[51] Int. Cl.[6] ..... B65H 3/06

[52] U.S. Cl. ..... 428/141; 428/131; 428/492; 428/495; 271/109; 271/117; 271/119; 271/21; 399/393; 492/59; 492/37

[58] Field of Search ..... 428/131, 492, 428/141, 495; 271/109, 117, 119, 21; 399/393; 492/59, 37

[56] References Cited

U.S. PATENT DOCUMENTS

| | | | |
|---|---|---|---|
| 3,306,491 | 2/1967 | Eisner et al. | 221/41 |
| 3,931,090 | 1/1976 | Amatangelo | 260/23.7 M |
| 4,149,797 | 4/1979 | Imperial | 29/132 |
| 4,314,006 | 2/1982 | Lentz et al. | 428/494 |
| 4,374,212 | 2/1983 | Martellock et al. | 523/212 |
| 4,934,686 | 6/1990 | Ono et al. | 271/117 |
| 5,120,609 | 6/1992 | Blaszak et al. | 428/446 |
| 5,267,008 | 11/1993 | Rebres et al. | 355/308 |
| 5,348,283 | 9/1994 | Yanagi et al. | 271/127 |
| 5,527,026 | 6/1996 | Padget et al. | 271/21 |
| 5,723,214 | 3/1998 | Yamazaki et al. | 428/364 |

FOREIGN PATENT DOCUMENTS

| | | | |
|---|---|---|---|
| 0 446 382 A1 | 9/1991 | European Pat. Off. | C08L 23/16 |
| 0 539 003 A1 | 4/1993 | European Pat. Off. | B65H 3/06 |
| 0 683 438 A2 | 11/1995 | European Pat. Off. | G03G 15/00 |

OTHER PUBLICATIONS

Trade Literature—Natsyn Polyisoprene Rubber—Goodyear Tire & Rubber Co.

Trade Literature—Uniroyal Chemical Company—Polymers Selection Guide.

Natural Rubber Technical Information Sheet—Malaysian Rubber Producers' Research Association—D71 and D72—1979.

*Primary Examiner*—William P. Watkins, III
*Attorney, Agent, or Firm*—John A. Brady

[57] ABSTRACT

Paper moving rollers, for use in printer or duplicating machines, particularly those using an autocompensating feed system, are disclosed. These rollers have a long effective life and provide reliable single feed of paper while minimizing double and multiple feeds. The rollers are made from a rubber composition comprising isoprene rubber, at least one ozone-resistant rubber, such as EPDM, and a rubber curing system substantially soluble in the rubber mixture. The process for moving paper in a printer or duplicating machine using these rollers is also disclosed.

28 Claims, 4 Drawing Sheets

RUBBER-BASED PAPER FEED ROLLERS

TECHNICAL FIELD

The present invention relates to rollers used for feeding individual sheets of paper into, for example, printing or duplicating devices.

BACKGROUND OF THE INVENTION

In a typical printing or duplicating (e.g., photocopying) device, individual sheets of blank paper are fed from a paper stack (e.g., a paper supply tray) into the area in which the printing or duplicating takes place. Frequently, such a feed device utilizes a pick roller to accomplish that function.

With paper picking devices there typically exists a critical normal force relationship between the pick roller and the paper stack. Too much normal force (i.e., the force which holds the roller onto the paper stack) will result in multi-feeds and too little normal force will result in feed failures. In conventional devices, either the paper stack or the pick roll is spring loaded against the other to provide normal force for picking. Even with extensive tuning of this force, the result is usually a very narrow range of media that will run reliably on the device. These systems are critically affected by a variety of media characteristics: for example, density, net weight, stiffness, and smoothness of the media surface. When the paper stack is spring loaded, density or net weight of the media can vary the resultant normal force. When the pick roller is spring loaded against the paper, the problem with counterbalancing the weight is eliminated but the media stiffness and media surface smoothness are still problems. Presently, the common way to deal with these problems is through a force adjustment mechanism that requires operator intervention when switching from media to media. U.S. Pat. No. 3,306,491, Eisner, et al., issued Feb. 28, 1967, shows a driver roller on a pivoted gear train; there is no mention of autocompensation. U.S. Pat. 4,934,686, Ono, et al., issued Jun. 19, 1990, shows a drive roller on a pivoted arm but not with autocompensation from a gear train.

Autocompensating paper feeders address these issues. In these devices, the pick roller and the paper stack are not spring loaded against one another. The pick roll is mounted on a rotating swing arm. The roll rests on the paper stack. When the pick roll drive is initiated through a gear located on the pivot shaft with the swing arm and counter-rotating to the direction of feed, a torque is applied to the swing arm through the downstream gear train which rotates the swing arm and pick roll into the paper stack. The normal force generated is dictated by the buckling resistance of the media being picked. In theory, the normal force generated is no more than is required to buckle a single sheet of media plus the friction resistance between the first and second sheets. As soon as the sheet has moved, the normal force automatically relaxes. The beauty of this picking device is that it never delivers more normal force than what is required to feed a single sheet of media, and its picking power exceeds any foreseeable requirement. Such a device is taught in U.S. Pat. No. 5,527,026, Padget, et al., issued Jun. 18, 1996. Since these paper feeders develop exactly the amount of force necessary to move each sheet of paper, they require the use of rollers which have very high coefficients of friction (about 1.7 or higher).

To be effective in this sort of environment, the materials used to make the pick (feed) rollers must satisfy a long list of stringent and sometimes inconsistent performance criteria. Specifically, the elastomer used must meet the following requirements:

High Friction—the material must be high friction and maintain that high friction over the lifetime of the machine, typically 250,000 sheets of paper fed.

Non-Glazing—the material must be non-glazing over its entire lifetime. That is, it must not attract paper (or other) dust so that the dust builds up on the surface of the roller and reduces the high friction.

Wear Resistant—the material must be such that it does not wear down or become smooth, over the course of its life, thereby causing increased chances of misfeeds.

Non-Blooming—the elastomer material must not bleed powders to its surface ("blooming") since this will reduce the high friction. Such bleeding occurs when powder ingredients are present in the elastomer above their solubility level.

Non-Staining—the material must not stain the paper as the roller rests on it. That is, ingredients that stain must not bleed out of the elastomer material.

Non-Marking—the material must not leave marks when it rubs against the paper during feeding.

Ozone Resistant—ozone resistance (that is, resistance to surface cracking due to atmospheric ozone) is important since ozone cracks accelerate the surface wear of the roll.

Oxidation Resistant—oxidation resistance is necessary since oxidation of the material causes it to become sticky, load up with paper dust, and lose its high friction.

Made From Commonly Available Ingredients—the elastomer ingredients must be commonly available so that supply will be constant during the entire time the machine is manufactured.

Low Cost—cost is a consideration since the machine must be competitively priced.

It has now been found that specific rubber compositions, when used in paper-moving pick rollers, meet all of these criteria, and are effective, long-lasting paper feed pick rollers, particularly in autocompensating feed devices. It has also been found that the relatively soft, high friction rollers of the present invention minimize the number of double or multiple feeds which occur.

SUMMARY OF THE INVENTION

The present invention encompasses paper moving rollers made from a rubber composition comprising: (a) isoprene rubber, (b) at least one ozone-resistant rubber, wherein the ratio by weight of (a):(b) is from about 75:25 to about 65:35, and (c) an effective amount of a rubber curing system substantially soluble in the mixture of (a) and (b). Preferred rubber compositions additionally contain an effective amount of a mild antioxidant, such as a phenolic antioxidant. The preferred ozone-resistant rubber is ethylene-propylene-diene-monomer (EPDM). In particularly preferred rollers, at least a portion of the surface of the roller is ground such that it has a surface roughness of between about 6 and about 12 microns.

The invention also encompasses a process for moving paper, such as in a printing or duplicating device, comprising the steps of:

(1) contacting the face of a sheet of paper with one or more paper moving rollers, said rollers made from a rubber composition comprising
   (a) isoprene rubber,
   (b) at least one ozone-resistant rubber, wherein the ratio by weight of (a):(b) is from about 75:25 to about 65:35, and
   (c) an effective amount of a rubber curing system substantially soluble in the mixture of (a) and (b); and (2) causing said paper moving rollers to rotate in the same direction thereby, through frictional forces, moving said sheet of paper in the direction of said rotation.

All ratios and percentages stated herein are "by weight," unless otherwise specified.

DESCRIPTION OF THE DRAWINGS

The attached drawings illustrate an exemplary autocompensating paper feeding device in which the rollers of the present invention may be utilized. In this device.

DETAILED DESCRIPTION OF THE INVENTION

Figure 1:
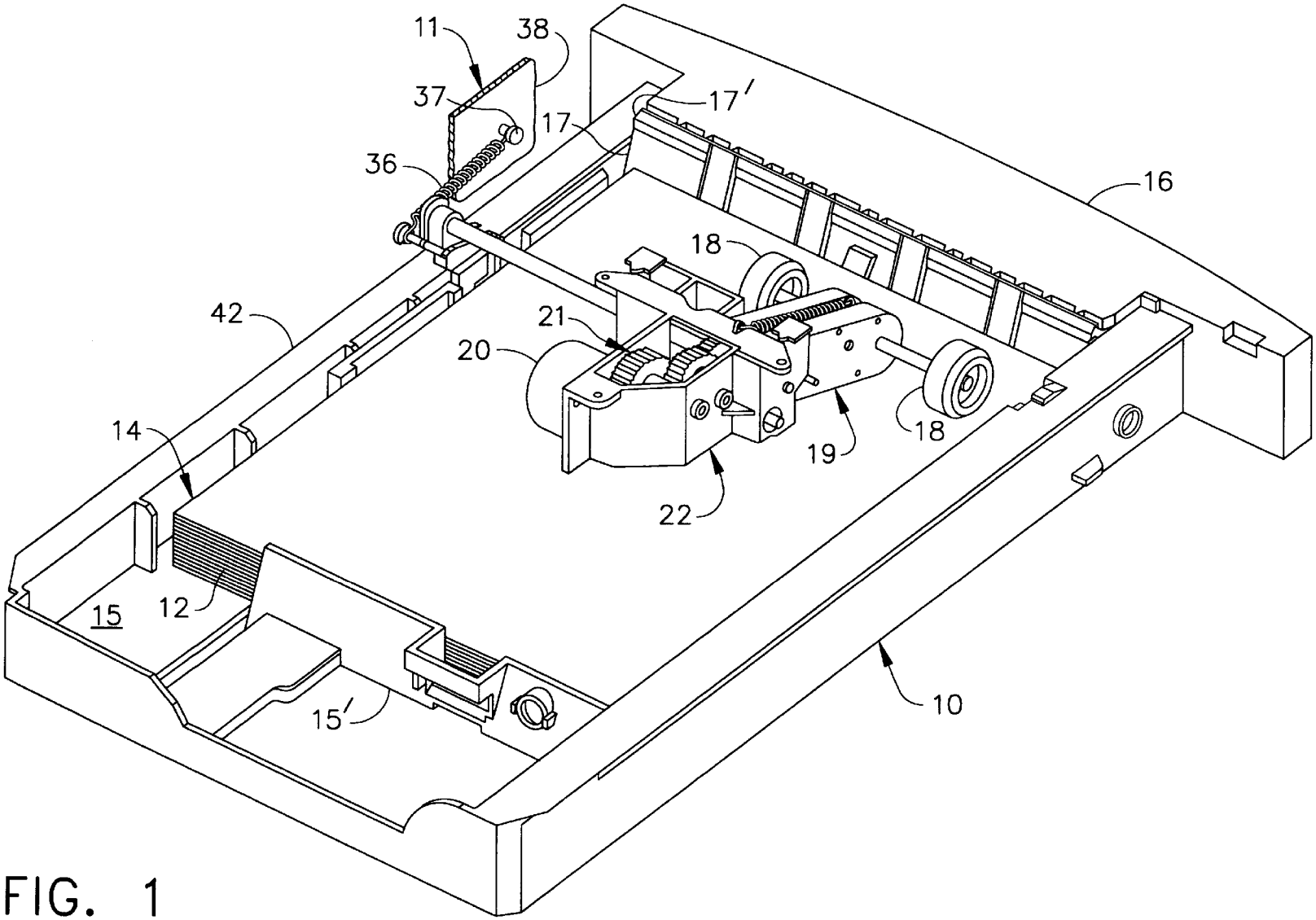
FIG. 1 is a perspective view of a printer tray having a sheet separator with a stack of sheets of media therein and shown enlarged for clarity purposes.
Figure 2:
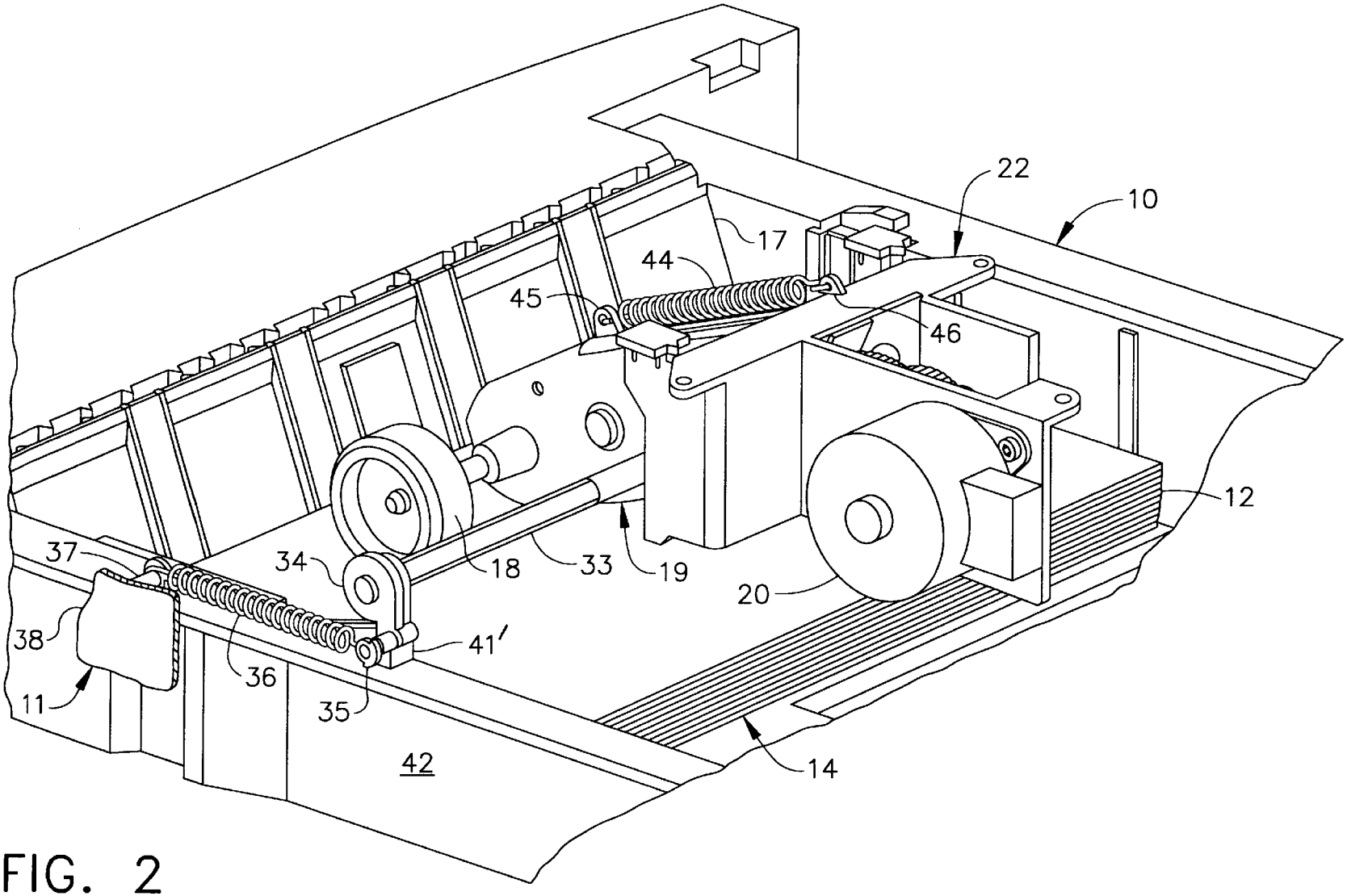
FIG. 2 is an enlarged perspective view of a portion of the tray of FIG. 1, taken from the opposite side of FIG. 1.

The present invention relates to rollers for moving paper (also known as pick rollers), for example in printing or duplicating devices, out of a paper feed tray and into a processing area (e.g., where printing takes place). The rollers, which are described in the present application, are especially useful in autocompensating feeders where the normal force of the feeder roll on the paper supply tray is relatively low (about 20 grams). These rollers are made from a specifically-defined rubber composition which includes three required components: (1) isoprene rubber, (2) at least one ozone-resistant rubber, and (3) a rubber curing system. The rubber composition, as formulated, has a relatively high coefficient of friction (i.e., the tangential force provided by the roller surface divided by the normal force of the roller surface on the surface of the paper) of at least about 1.7, and as high as about 2. The rubber composition is also relatively soft, having a hardness of about 40 Shore A durometer.

The isoprene rubber component provides the rubber composition used in the present invention with very high friction levels. The isoprene component may include natural isoprene rubbers, as well as synthetic isoprene rubbers. In addition to isoprene, other high friction rubbers which can be used in the present invention include ethylene-propylene-diene monomer (EPDM) rubbers and epichlorohydrin terpolymer rubbers (e.g., Hydrin™ commercially available from Zeon Chemical). However, the isoprenes provide the best results. The rubbers utilized must not only have high friction characteristics and be relatively soft, but must also, when formulated in the composition, satisfy the range of other characteristics set forth previously in the present application. Examples of specific materials which may be used as the isoprene rubber component include the Natsyn™ polyisoprene rubber series, commercially available from Goodyear, as well as Nipol™ IR, commercially available from Nippon Zeon.

The rubber composition of the present invention must also include at least one ozone-resistant rubber. These materials are inherently immune to attack by atmospheric ozone and oxygen. The ozone-resistant rubbers may be used singly in the present invention or mixtures of such materials may be used. The use of such materials in the compositions prevents the pick rollers of the present invention from degrading over time. Materials which are useful as the ozone resistant rubber include neoprene, ethylene-propylene-diene-monomer (EPDM) rubber, chlorosulfonated polyethylene rubber, and mixtures thereof. EPDM rubber is particularly preferred since it is chemically compatible (i.e., it is non-polar) with the isoprene rubber. The EPDM used should have a low molecular weight so it will match the viscosity of the isoprene (and, hence, blend well with it) and it should be fast-curing so it will co-cure with the isoprene. Although ozone resistance may be obtained by adding certain powder anti-ozonants, such as Wingstay™ 300 (Goodyear), to the isoprene rubber, the use of EPDM is preferable since (a) EPDM is more effective in retarding ozonation, and (b) the best anti-ozonant powders tend to stain. Examples of ozone-resistant rubbers utilized in the present invention include the commercial EPDM rubber series Royalene™ (Uniroyal), EPsyn™ (Copolymer Rubber), and Nordel™ (DuPont), as well as the neoprene rubber series Neoprene™ (DuPont) and the chlorosulfonated polyethylene rubber series Hypalon™ (DuPont).

The isoprene and ozone-resistant rubbers are combined in the compositions of the present invention within a very narrow weight range. The intent is to minimize the amount of ozone-resistant rubber in the composition since its presence could potentially lower the high friction coefficient imparted by the isoprene. Specifically, the ratio, by weight, of isoprene to ozone-resistant rubber is from about 75:25 to about 65:35, and is preferably about 70:30.

The final component in the rubber compositions of the present invention is a rubber curing system which is effective to cure the isoprene and ozone-resistant components of the composition. The curing system must be substantially soluble in the rubber mixture. As used herein, "substantially soluble" means there is no appreciable migration of the curing ingredients out of the rubber. If the curing system is not substantially soluble, materials (such as sulfur) may bleed out of the composition to the roller surface. This will lower the friction coefficient of the rubber. Also, if those materials come into contact with components of the printer or duplicating device, they can corrode the electronics of those devices. Examples of curing systems which may be used in the compositions of the present invention include zinc oxide, stearic acid, zinc-2-ethylhexanoate, tetrabutylthiuram disulfide, tetramethylthiuram disulfide, sulfur, N-oxydiethylene benzothiazyl-2-sulfenamid, diphenylguanidine, dicumyl peroxide, benzoyl peroxide, and mixtures thereof. The rubber curing system is used in the compositions of the present invention in an effective amount (i.e., an amount effective to cure the particular rubber composition formulated). The precise amount will vary from composition to composition based on the particular components included, but is easily determined by one skilled in the art. Preferably, the compositions contain from about 0.5% to about 15% of the rubber curing system.

The rubber compositions utilized in the present invention may optionally include a mild antioxidant. Once again, the purpose of this component is to maintain the integrity of the rubber over time in an oxygen-containing environment. Such antioxidants are included in an effective amount (i.e., an amount effective to provide the antioxidant benefit to the rubber composition) and preferably are included in the present invention at from about 0.5% to about 5% of the composition. Examples of useful mild antioxidants include hindered phenols, hindered bisphenols, hydroquinolines, and mixtures thereof, with hindered phenol antioxidants being particularly preferred since they are non-blooming and non-staining. Examples of such materials include the Wingstay™ series of materials, commercially available from Goodyear, as well as the Agerite™ series, commercially available from R. T. Vanderbilt.

Other components conventionally used in rubber compositions, such as those used for pick rollers, may be included at their conventional and art-established levels for their conventional purposes. Examples of such components include white fillers (such as clay, silica, calcium carbonate), carbon black (in small amounts, since this material in large amounts may cause marking) and oils (paraffinic or naphthenic).

The paper moving rollers of the present invention are made by blending the components of the rubber composition as is well known in the art. The rubber composition is then molded and cured to form the rollers. Each roller may be molded individually or a continuous hose may be molded from the rubber composition with the rollers cut off from the hose at their desired width. The cure time and cure temperatures utilized are defined by the particular rubbers and curing system used in the composition. However, a curing temperature about 320° F. (about 160° C.) with a curing time of about 15 minutes is fairly typical.

The paper moving rollers of the present invention should preferably have surface roughness to help grab each individual sheet of paper from the feed stack. This may be accomplished by molding the roller to have treads. However, a preferred mode of imparting surface roughness is by grinding at least a portion of the surface of the roller. Preferred rollers of the present invention are those where the entire outer surface of the roll is ground. This grinding is accomplished using a grinding wheel or a grinding belt. The fineness of the grit on the wheel or belt, the revolution speed of the wheel or belt, and the force and time of the wheel or belt on the roller surface will determine the extent of roughness imparted to the roller surface. Preferred rollers of the present invention have a surface roughness of from about 6 to about 12 microns (average peak to valley on the roller surface measured parallel to the roller axis). This roughness can be measured using a surface analyzer. It is preferred that the roller be ground such that, in use, it turns against the grain of the grind (i.e., the roller pushes the paper in the same direction as the roller turned against the grind wheel or belt).

In the process aspect of the present invention, a sheet of paper is contacted with one or more of the paper moving rollers described above. This paper could be the top sheet of a plurality of sheets contained in a paper feed tray of a printer or duplicating device. It is preferred that the paper moving roller or rollers are biased toward the paper with a relatively low normal force, such as from about 15 to about 25 grams, preferably about 20 grams. In use, the rollers are caused to rotate (for example, by a motor or other drive device); each roller rotates preferably in the same direction and preferably at approximately the same speed. Since the rollers are in contact with the paper, through frictional forces they cause the sheet of paper to move in the direction of the rollers' rotation. Once the sheet of paper is moved into, for example, the printing portion of the device, the rollers then come into contact with the next sheet of paper in the paper feed tray. It is preferred that the feed device which incorporates the rollers of the present invention is an autocompensating feeder such as that described in U.S. Pat. No. 5,527,026, Padget, et al., issued Jun. 18, 1996, incorporated herein by reference.

An example of such an autocompensating feeder is shown in the attached drawings. Referring to the drawings, and particularly FIG. 1, there is shown a tray (10) used in a printer (11). The tray (10) supports a plurality of sheets (12) of a media such as bond paper, for example, in a stack (14). The sheets (12) may be other media, such as labels or envelopes, for example.

The tray (10) has a bottom surface or wall (15) supporting the stack (14) of the sheets (12) therein. The tray (10) has a rear restraint (15') abutting a trailing edge of each of the sheets (12) of the stack (14). Adjacent to its front end (16), the tray (10) has an inclined surface or wall (17) integral with the bottom surface (15) of the tray (10).

The surface (17) is inclined at an obtuse angle to the bottom surface (15) of the tray (10) and to the adjacent end of the stack (14) of the sheets (12). The inclined or angled surface (17) constitutes a portion of a dam against which each of the sheets (12) in the stack (14) is advanced into engagement. The dam also includes a vertical surface (17') above the inclined surface (17). The sheets (12) are advanced from the vertical surface (17') toward a processing station of the printer (11) at which the printing occurs.

Each of the sheets (12) is advanced from the stack (14) by a pair of feed rollers (18), which are rotatably mounted on a pivotally mounted arm (19). These feed rollers are preferably those described in the present application. The feed rollers (18) are driven from a motor (20) through a gear drive train (21). The motor (20) is alternately turned off and on by control means (not shown) as each of the sheets (12) is advanced from the top of the stack (14).

Figures 3, 4:
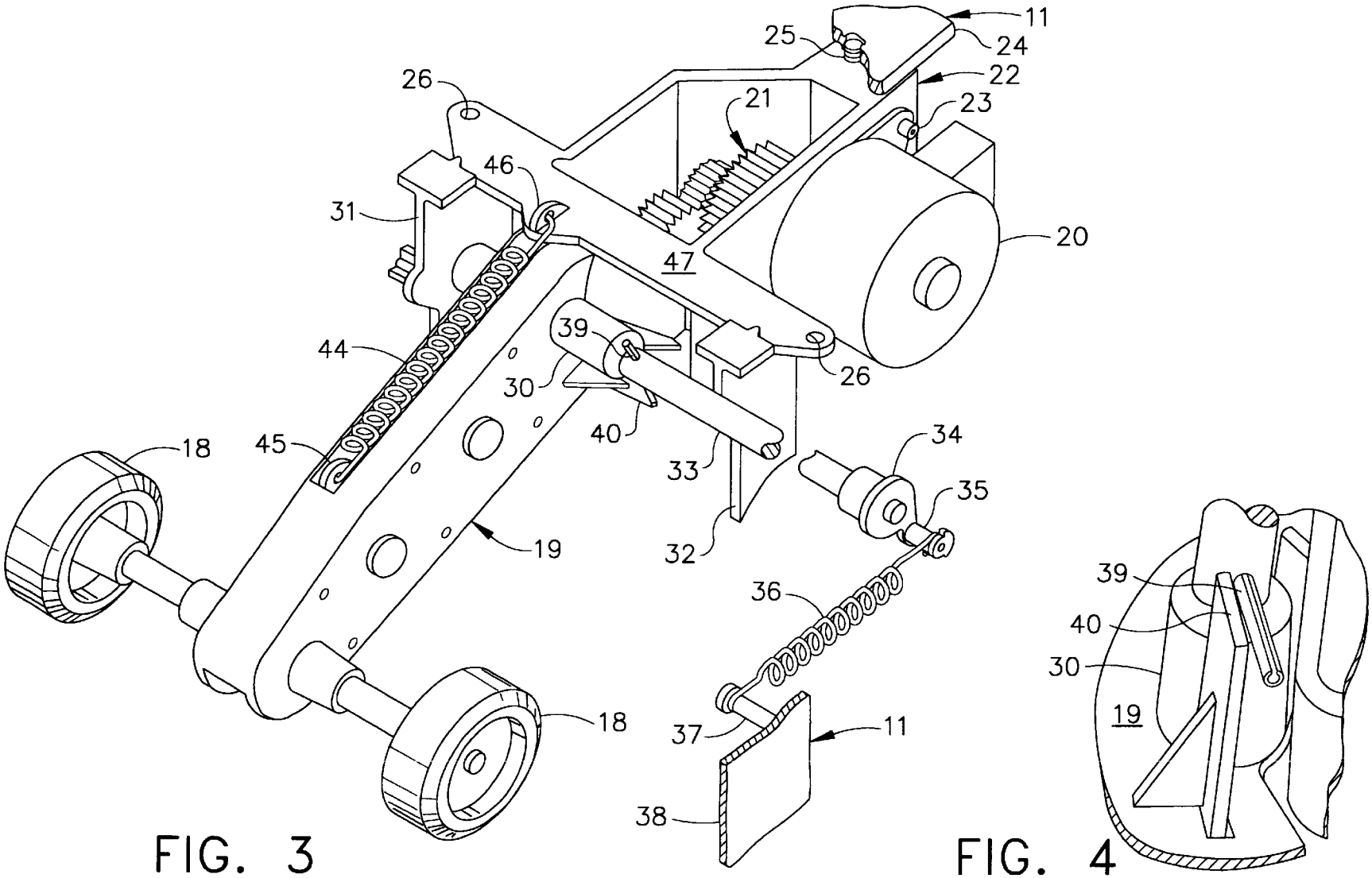
FIG. 3 is a perspective view, partially exploded, of a sheet advancing mechanism for advancing the uppermost sheet of a stack of sheets from the tray of FIG. 1 to a processing station of the printer at which printing occurs.
FIG. 4 is an enlarged fragmentary perspective view of a portion of the sheet advancing mechanism of FIG. 3, looking up from beneath to show a pin for moving feed rollers of the sheet advancing mechanism of FIG. 3 into engagement with the uppermost or top sheet in a stack of sheets within the tray when the tray is inserted within a printer.

The motor (20) (see FIG. 3) is supported on a bracket (22) by screws (23) (one shown). The bracket (22) is fixed to a sheet metal portion (24) of the printer (11). Self-tapping screws (25) extend upwardly through clearance holes (26) in the bracket (22) into extruded holes (not shown) in the sheet metal portion (24) of the printer (11).

The pivotally mounted arm (19) has a sleeve (30) fixed thereto. The sleeve (30) is rotatably supported by a pair of substantially parallel vertical walls (31 and 32) of the bracket (22) through a pivot shaft (33) extending through the walls (31 and 32) and being rotatably supported thereby.

Figure 5:
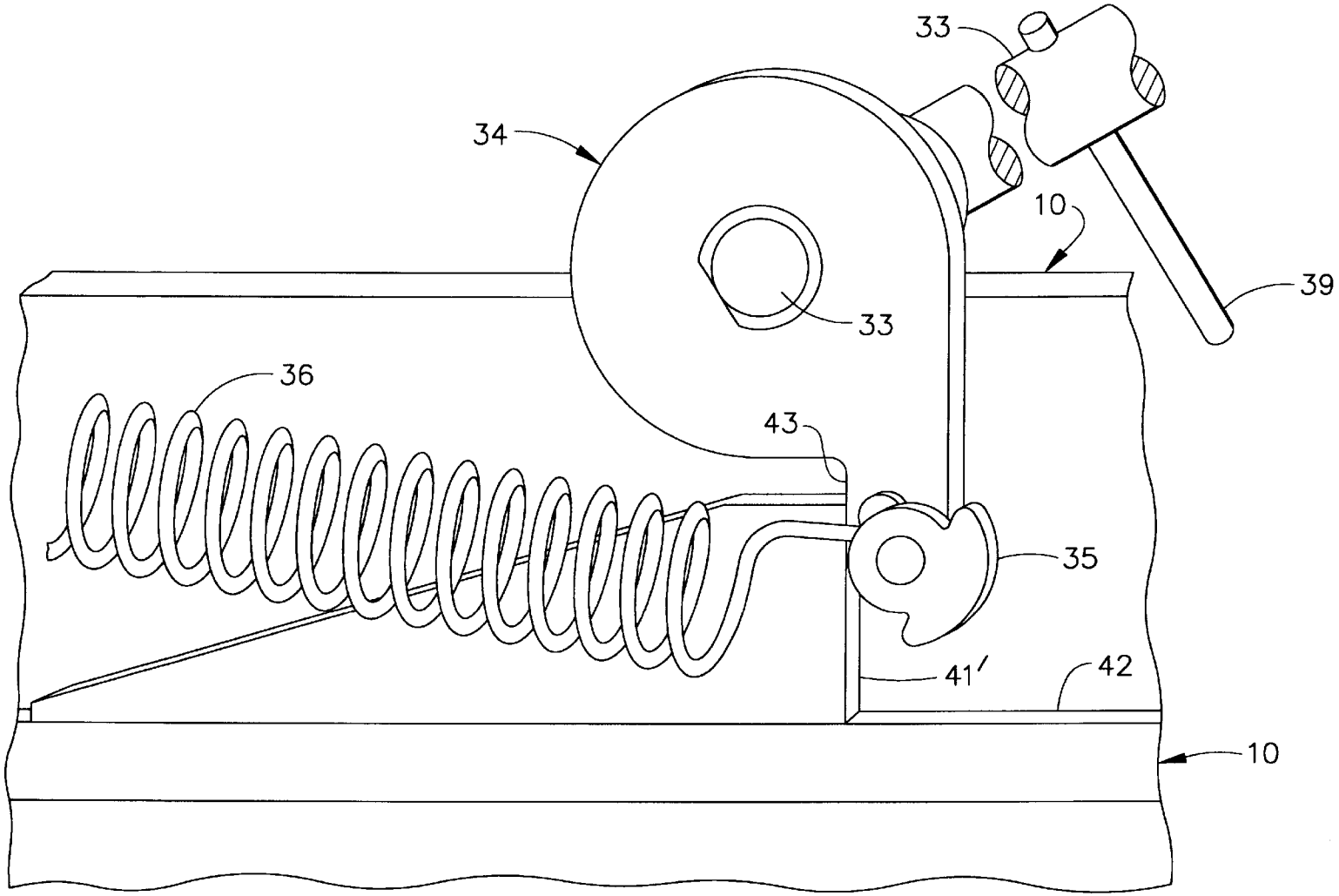
FIG. 5 is an enlarged fragmentary side elevational view of a portion of the tray of FIG. 1 showing the pin of FIG. 4 for moving feed rollers of the sheet advancing mechanism of FIG. 3 into engagement with the uppermost or top sheet in a stack of sheets within the tray when the tray is inserted within a printer.

A bell crank (34) (see FIG. 5) is mounted on one end of the pivot shaft (33) and fixed thereto. The bell crank (34) has a spring connector (35) fixed thereto and to which one end of a spring (36) is secured. The spring (36) has its other end connected to a post (37) (see FIG. 1) extending from a side frame (38) of the printer (11).

The spring (36) (see FIG. 5) continuously urges the bell crank (34) clockwise so that a pin (39) fixed to the pivot shaft (33) engages a rib (40) (see FIGS. 3 and 4) on the sleeve (30). This engagement of the pin (39) with the rib (40) holds the pivotally mounted arm (19) in a raised position in which the feed rollers (18) cannot engage the top sheet of the stack (14). This occurs when the tray (10) is removed from the printer (11).

When the tray (10) is inserted within the printer (11), a vertical wall (41') (see FIG. 5) extending upwardly from a side wall (42) of the tray (10) engages a flat surface (43) of the bell crank (34) to rotate the bell crank (34) counterclockwise against the force of the spring (36). This counterclockwise rotation of the bell crank (34) causes counterclockwise rotation of the pivot shaft (33), which has the bell crank (34) fixed thereto, so that the pin (39) of the pivot shaft (33) ceases to engage the rib (40) on the sleeve (30). Without the pin (39) engaging the rib (40), the pivotally mounted arm (19) pivots counterclockwise (as viewed in FIG. 3), because of gravity, so that the feed rollers (18) engage the top of the stack (14) of the sheets (12) (see FIG. 1).

A counterbalance spring (44) (see FIG. 3) extends between an ear (45) on the pivotally mounted arm (19) and an ear (46) and a flat portion (47) of the bracket (22). The counterbalance spring (44) limits the force applied by the feed rollers (18) to the top of the sheets (12) in the stack (14) (see FIG. 1).

When the feed rollers (18) are in the feed or sheet advance position in which they engage the top sheet of the stack (14), the top sheet is advanced by rotation of the feed rollers (18) through energization of the motor (20). This causes the leading edge of the top sheet to engage the inclined surface (17) of the tray (10), which is preferably formed of plastic. As the sheet of paper advances to a new position for further processing, such as for printing in a printer, the feed rollers are then able to come into contact with the next sheet on the stack (14).

The following example of the present invention is intended to be illustrative and not limiting thereof.

EXAMPLE

A rubber composition having the formulation set forth in the table below is formulated by combining the stated ingredients, typically on a two-roll mill or in an internal mixer.

| Material | Trade Name | Manufacturer | Parts by Weight |
|---|---|---|---|
| Polyisoprene Rubber | Natsyn 2200 | Goodyear | 70 |
| EPDM Rubber | Royalene 535 | Uniroyal | 30 |
| Zinc Oxide/Oil Dispersion | Zic Stick 85 | Rhein Chemie | 5.00 |
| Zinc 2-ethyl-hexanoate Dispersion | E(OCTOATE)50 | Polychem Dispersions | 4.00 |
| Hindered Phenol Antioxidant[1] | Wingstay L HLS | Goodyear | 1.25 |
| NOBS Accelerator[2] Dispersion | Rhenogran MBS-80 | Rhein Chemie | 0.88 |
| TBTD Accelerator[3] Dispersion | E(BT)55 | Polychem Dispersions | 1.82 |
| DPG Accelerator[4] | Rhenogran DPG-80P | Rhein Chemie | 1.25 |
| Rubbermaker's Sulfur Dispersion | Rhenogran S-80 | Rhein Chemie | 0.88 |
| TOTAL | | | 115.08 |

[1]butylated reaction product of p-cresol dicyclopentadiene
[2]N-oxydiethylene-2-benzothiazyl-sulfenamid
[3]tetrabutylthiuram disulfide
[4]diphenyl guanidine The rubber composition is injected under pressure into molds to form the paper moving rollers of the present invention. The composition is cured in the molds for 15 minutes at 320° F. (160° C.). The rollers formed are about 1.0 cm wide and about 0.3 cm thick. The surface of each of these rollers is ground with a grinding wheel to produce a surface roughness of about 8 microns.

These paper moving rollers, when used in an autocompensating feed device such as that described in the present application, provide reliable single paper feed characteristics over the extended life of the paper roller. Further, the rollers are relatively low cost to produce and do not mark or stain the paper in the printer.

What is claimed is:

1. A paper moving roller mounted on an auto compensating, pivotally-mounted swing arm, said roller, when in contact with paper, having initial light pressure against said paper wherein force applied through said swing arm to rotate said roller applies increased normal force against said paper until said roller rotates, said roller being made from rubber composition comprising:

(a) isoprene rubber, (b) at least one ozone-resistant rubber, wherein the ratio by weight of (a):(b) is from about 75:25 to about 65:35, and (c) an effective amount of a rubber curing system substantially soluble in the mixture of (a) and (b).

2. The roller according to claim 1 wherein the rubber composition has a coefficient of friction of at least about 1.7.

3. The roller according to claim 2 wherein the rubber composition additionally contains an effective amount of a mild antioxidant.

4. The roller according to claim 3 wherein the ozone-resistant rubber is selected from the group consisting of EPDM, neoprene, chlorosulfonated polyethylene, and mixtures thereof.

5. The roller according to claim 4 wherein the ozone-resistant rubber is EPDM.

6. The roller according to claim 5 wherein the rubber curing system is selected from the group consisting of zinc oxide, stearic acid, zinc 2-ethyl-hexanoate, tetrabutylthiuram disulfide, tetramethylthiuram disulfide, sulfur, N-oxydiethylenebenzothiazyl-2-sulfenamid, diphenylguanadine, dicumyl peroxide, benzoyl peroxide, and mixtures thereof.

7. The roller according to claim 6 wherein the antioxidant is selected from the group consisting of hindered phenols, hindered bisphenols, hydroquinolines, and mixtures thereof.

8. The roller according to claim 5 wherein the ratio by weight of (a):(b) is about 70:30.

9. The roller according to claim 7 wherein the ratio by weight of (a):(b) is about 70:30.

10. The roller according to claim 4 wherein the rubber composition contains from about 0.5% to about 15% by weight of the rubber curing system.

11. The roller according to claim 10 wherein the rubber composition contains from about 0.5% to about 5% by weight of the antioxidant.

12. The roller according to claim 4 wherein at least a portion of the outer surface of the roller is ground to form a rough surface.

13. The roller according to claim 12 having a surface roughness of from about 6 to about 12 microns.

14. The roller according to claim 9 having a surface roughness of from about 6 to about 12 microns.

15. A process for moving paper comprising:

(1) contacting the face of a sheet of paper with one or more paper moving roller or rollers, said roller or rollers mounted on an autocompensating, pivotally-mounted swing arm said roller or rollers having initial light pressure against said paper and applying force through said swing arm to rotate said roller or rollers wherein said force applied through said swing arm to rotate said roller or rollers applies increased normal force against said paper until said roller or rollers rotate, said roller or rollers being made from a composition comprising (a) isoprene rubber, (b) at least one ozone-resistant rubber, wherein the ratio by weight of (a):(b) is from about 75:25 to about 65:35, and (c) an effective amount of a rubber curing system substantially soluble in the mixture of (a) and (b); and (2) causing said paper moving roller or rollers to rotate thereby, through frictional forces, moving said sheet of paper in the direction of said rotation.

16. The process according to claim 15 carried out in a printing or duplicating device.

17. The process according to claim 16 wherein the sheet of paper contacting the rollers or of a plurality of sheets of paper in a paper feed tray.

18. The process according to claim 15 wherein the rollers or roller is biased toward the surface of the sheet of paper.

19. The process according to claim 18 wherein the rollers or roller is biased with a normal force of from about 15 to about 25 grams.

20. The process according to claim 15 wherein at least a portion of the outer surface of the rollers or roller is ground to form a rough surface.

21. The process according to claim 20 wherein the roller or rollers have a surface roughness of from about 6 to about 12 microns.

22. The process according to claim 15 wherein the rubber composition has a coefficient of friction of at least about 1.7.

23. The process according to claim 22 wherein the rubber composition additionally contains an effective amount of a mild antioxidant.

24. The process according to claim 23 wherein the ozone-resistant rubber is selected from the group consisting of EPDM, neoprene, chlorosulfonated polyethylene, and mixtures thereof.

25. The process according to claim 24 wherein the ozone-resistant rubber is EPDM.

26. The process according to claim 25 wherein the rubber curing system is selected from the group consisting of zinc oxide, stearic acid, zinc 2-ethyl-hexanoate, tetrabutylthiuram disulfide, tetramethylthiuram disulfide, sulfur, N-oxydiethylenebenzothiazyl-2-sulfenamid, diphenylguanidine, dicumyl peroxide, benzoyl peroxide, and mixtures thereof.

27. The process according to claim 26 wherein the antioxidant is selected from the group consisting of hindered phenols, hindered bisphenols, hydroquinolines, and mixtures thereof.

28. The process according to claim 27 wherein the ratio by weight of (a):(b) is about 70:30.

* * * * *